US005551114A

United States Patent [19]

Lee

[11] Patent Number: 5,551,114

[45] Date of Patent: Sep. 3, 1996

[54] SHOESHINE ASSEMBLY

[76] Inventor: Tao-Pan Lee, No.37, Peishing, Chao-Chiao Chuen, Chao-Chiao Shiang, Miao-Li Hsien, Taiwan

[21] Appl. No.: 492,877

[22] Filed: Jun. 20, 1995

[51] Int. Cl.[6] ..... A46B 13/02

[52] U.S. Cl. ..... 15/28; 15/30; 15/36; 15/34; 15/97.100; 15/97.200; 15/258; 401/118

[58] Field of Search ..... 15/22.1, 23, 28, 15/30, 34, 36, 97.1, 97.2, 258; 401/118, 123, 125; 403/326, 361, 375

[56] References Cited

U.S. PATENT DOCUMENTS

| | | | |
|---|---|---|---|
| 249,336 | 11/1881 | Goldthwait | 401/118 |
| 258,815 | 5/1882 | Seabury | 401/118 |
| 2,934,775 | 5/1960 | Bergstrom | 15/28 |
| 3,162,876 | 12/1964 | Aronsen et al. | 15/28 |
| 3,251,086 | 5/1966 | Springer | 15/28 |
| 4,137,588 | 2/1979 | Sandt et al. | 15/28 |
| 4,781,487 | 11/1988 | Greco | 403/326 |

FOREIGN PATENT DOCUMENTS

| | | | |
|---|---|---|---|
| 1194796 | 5/1959 | France | 401/123 |
| 3615918 | 11/1987 | Germany | 15/28 |

*Primary Examiner*—David Scherbel
*Assistant Examiner*—Terrence R. Till
*Attorney, Agent, or Firm*—Pro-Techtor International

[57] ABSTRACT

The present invention relates to a shoeshine assembly comprising a main body, a rotable transmission shaft, a power motor for driving said transmission shaft, an upper casing for receiving said members; and a brush member having a fixing hole for inserted in transmission shaft for removing dust and dirt on the shoe; and a polishing member having a fixing hole for inserted in said transmission shaft for shining the surface of shoe; and a polish cup for receiving polish; and a lower casing resembling a hollow cashing with opening upward, the edge wall of said casing for covering up said upper casing; the characteristics lie in: a room formed when said lower casing covering up said upper casing, and in the room of said lower casing having a proper number of fixing members, and accommodating portions formed among said fixing members for receiving brush member, polishing member and polish cup; with the assembly of said members to give facilities such as easy for carrying and use, shrinking time of shoeshine.

1 Claim, 6 Drawing Sheets

SHOESHINE ASSEMBLY

BACKGROUND OF THE INVENTION

The present invention relates to a shoeshine assembly, and particularly to a shoeshine assembly accommodating a variety of shoeshine tools which is easy for carrying and use.

The conventional way of shoeshining relates to using a shoe brush coating with little polish for quick brushing the shoe manually, and then shining the shoe by using a piece of cloth. However, manual shoeshining often needs a lot of time, to make it, and because the shoe brush and polish are two individual items which are not easy for carrying. Therefore, there has a shoeshiner to replace the conventional shoeshine tool, said shoeshiner comprises a motor for driving shoe brush turning to shine the shoe. Though said shoeshiner may solve the problem of manual shoeshine to shorten the time of shoeshining, however, before use said shoeshiner must require hand tools for mounting or change of shoebrush so that it should need a lot of time for preparation. Further, said shoeshiner, brush and polish or other tool are not an integral assembly so that it is not convenient for carrying not to meet the demand of those often travelling or making official trip.

SUMMARY OF THE INVENTION

One object of the present invention is to provide a multifunctional shoeshine assembly which is easy for carrying.

Another object of the present invention is to provide a shoeshine assembly which is quick for assembly and replacement Of element without need of hand tool.

Still another object of the present invention is to provide a shoeshine assembly not to pollute the user's hand during use.

Still another object of the present invention is to provide a shoeshine assembly which has sufficient room for accommodating a variety of shoeshining tools.

DETAILED DESCRIPTION OF PREFERRED EMDBODIMENTS

Figure 1:
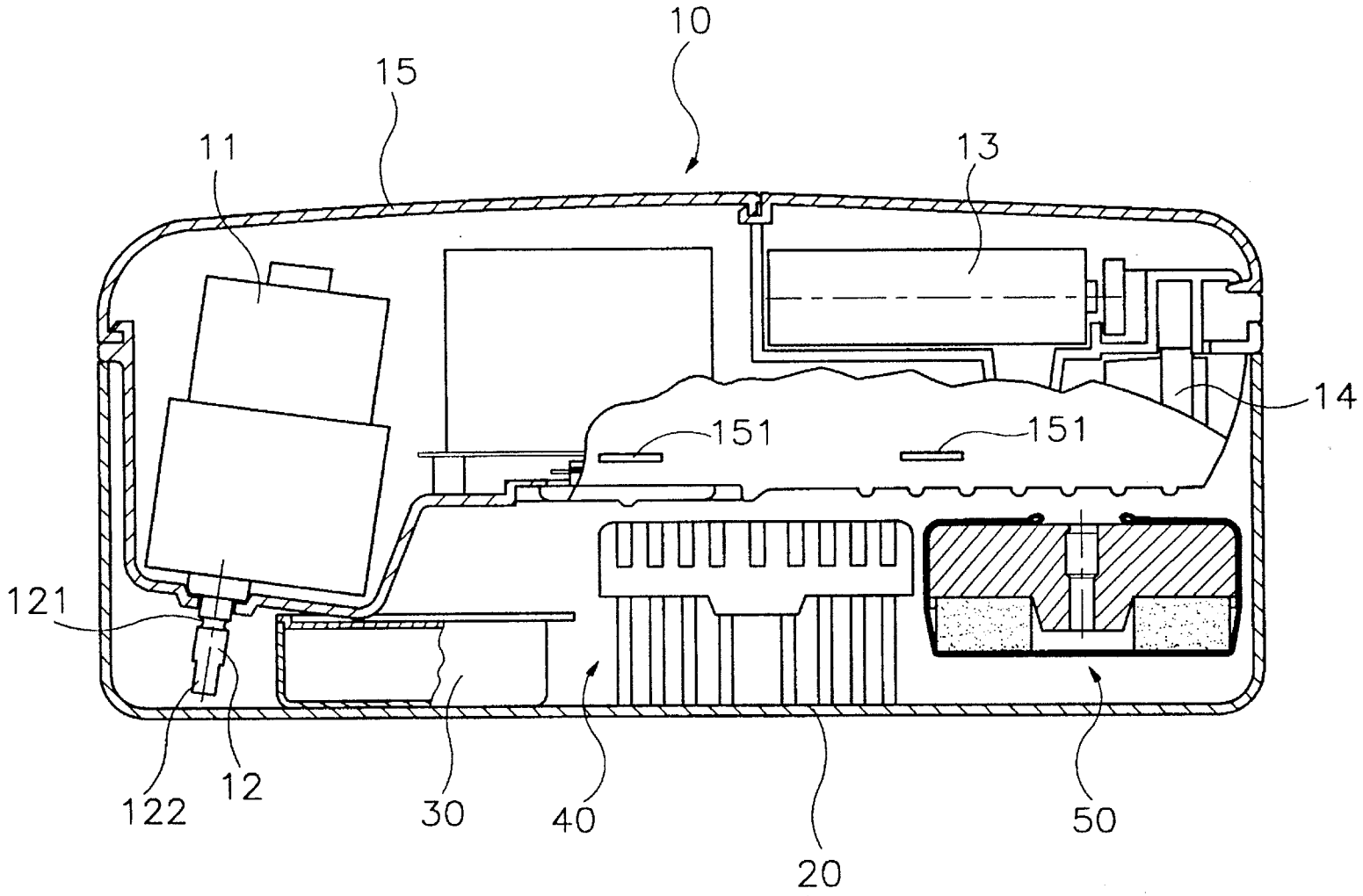
FIG. 1 is a partially exploded view showing the structure of each element.

The present invention relates to a shoeshine assembly comprises a main body 10, a lower casing 20 for covering said main body 10, a polish cup 30, a brush member 40, and a polishing member 50. For use, said brush member 40 or polishing member 50 can be quickly mounted on the transmission shaft of said main body 10, and said brush member 40 and polishing member 50 can be received in the lower casing 20 to make easy for carrying and use.

Referring to FIG. 1, said main body 10 comprises a motor 11, a transmission shaft 12 and battery 13 on said motor 11, a power socket 14 for AC power supply insertion, and an upper casing 15 for receiving said members. On the edge wall of said transmission shaft 12 has a ring groove 121 for fastening said brush member 40 and polishing member 50 so as to accomplish the purpose of axial location, and a plane portion 122 corresponding to said brush member and polishing member so as to accomplish the purpose of radial location (to be described in latter paragraph), on said upper casing 15 has a proper number of fastening grooves 151 for fastening said lower casing 20 (to be described in latter paragraph).

Figure 2:
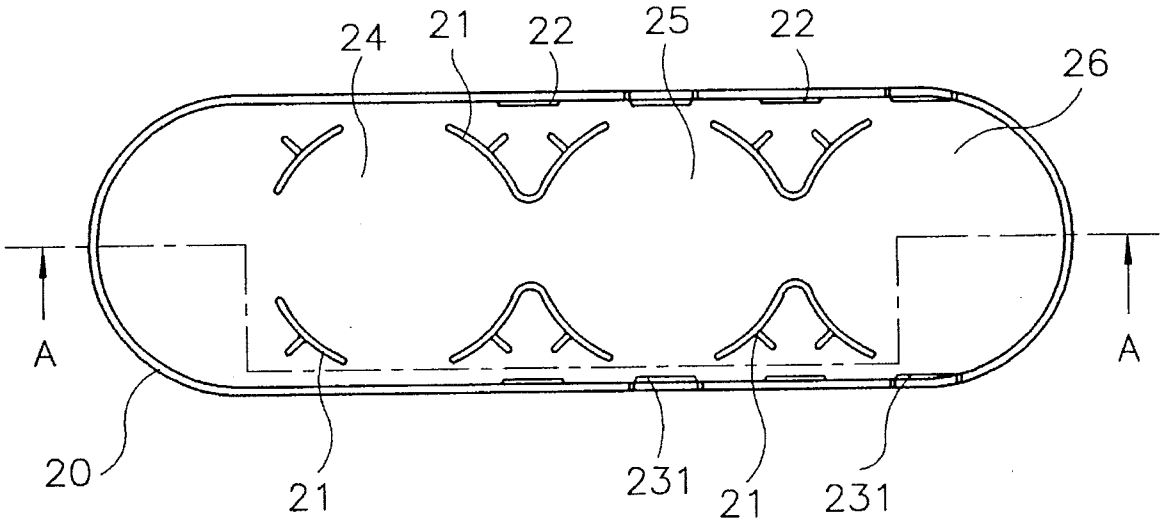
FIG. 2 is a top view of the present invention, showing the structure of fixing members.
Figure 3:
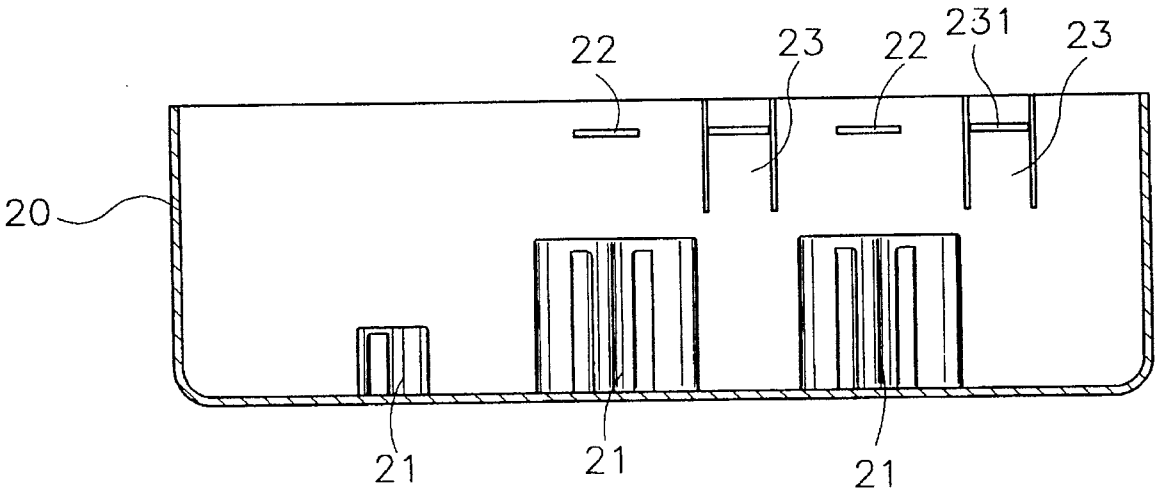
FIG. 3 is is an A—A exploded view of FIG. 2, showing the structure of flexible portion.

Referring to FIGS. 2 and 3, said lower casing 20 is a hollow casing with an opening facing upward wherein said lower casing 20 accommodates a proper number of fixing members 21, and accommodating portions 24, 25, 26 are formed among said fixing members 21 for accommodating polish cup 30, brush member 40 and polishing member 50. On the inner edge wall of said lower casing 20 corresponding to fastening groove 151 of upper casing 16 has a proper number of fastening members 22, said fastening members 22 resemble a convex body for fastening said fastening grooves 151, enabling said lower casing 20 tightly to fasten together with said main body 10. Further, said casing 20 is cut with a proper number of grooves on the edge wall of accommodating portions 25, 26, and a flexible portion 23 is formed among said grooves, and on the inner side of said flexible portion 23 has a stopper portion 231 for retaining said brush member 40 and polishing member 50 in said lower casing 20 firmly (to be described in latter paragraph).

Figure 4:
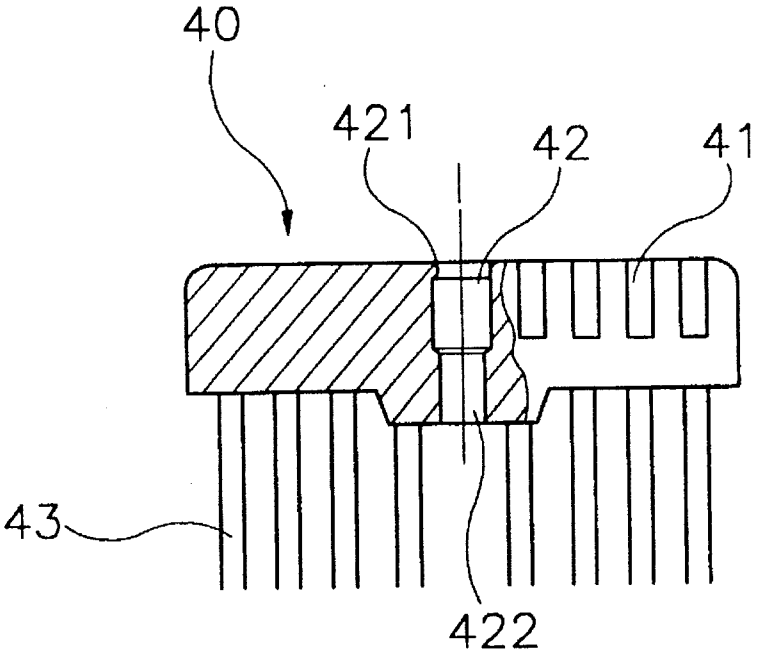
FIG. 4 is a partially exploded view of brush member of the present invention, showing the internal structure of fixing hole.

Referring to FIG. 4, said brush member 40 comprises a fixing seat 41 and a brush 43 mounted on the bottom of said fixing seat 41. Wherein on the central portion of said fixing seat is cut with a location hole 42, on the edge wall of said location hole 42 has a locating projection 421 and at least one plane portion 422 for fastening with the ring groove 121 and plane portion 122 of said transmission shaft 12 for fixing brush member 40 on said transmission shaft 12 so as to attain the purpose of axial and radial location.

Figure 5:
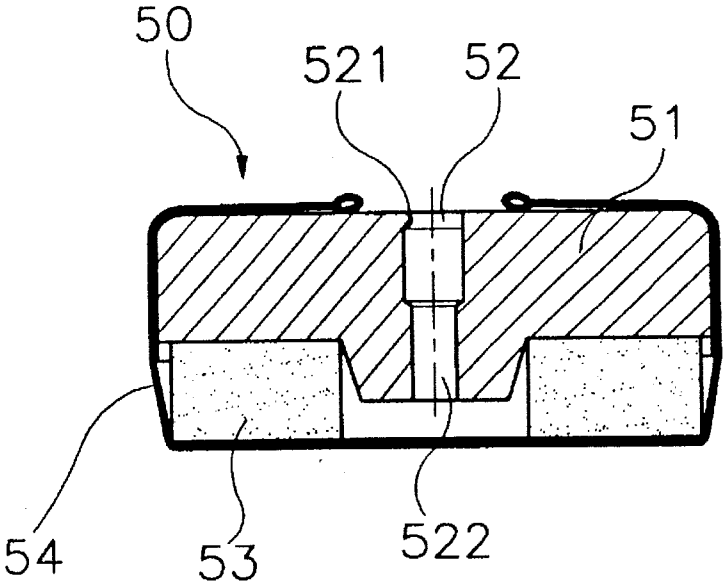
FIG. 5 is a partially exploded view of polishing member of the present invention, showing the internal structure of fixing hole.

Referring to FIG. 5, said polishing member 50 comprises a fixing seat 51 and a sponge 53 mounted on the bottom of said fixing seat 51. In said fixing seat 51 has a locating projection 521 and at least one plane portion 522 with the same structure as said fixing seat 41, for fixing polishing member 50 on the transmission shaft 12 so as to attain the purpose of axial and radial location. Further, on said polishing member 50 may be put on a cloth cover 54 for increasing polishing effect for better shining of shoes.

Figure 6:
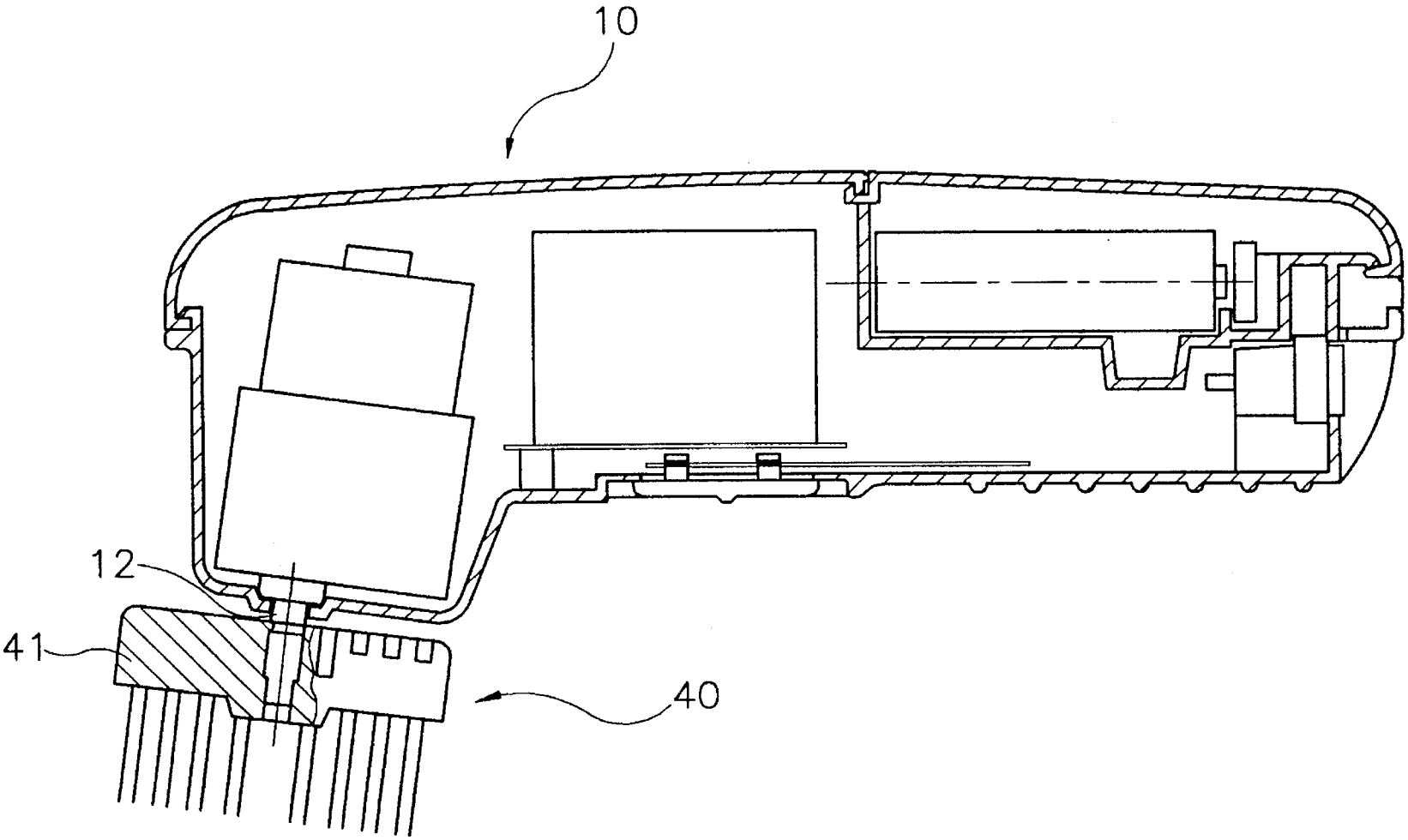
FIG. 6 is a diagramatic view showing the brush member of present invention mounted on the transmission shaft.
Figure 7:
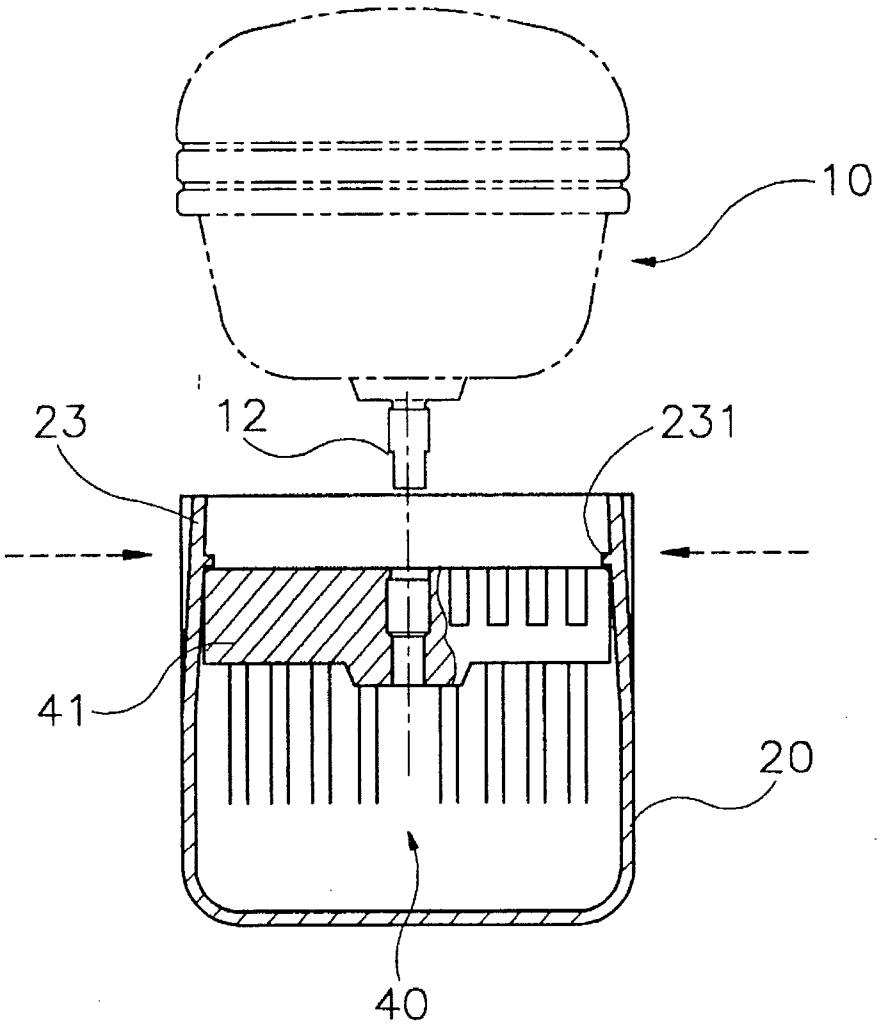
FIG. 7 is a diagramatic view showing flexible portion and stopper portion pushing against the top edge of said fixing seat.
Figure 8:
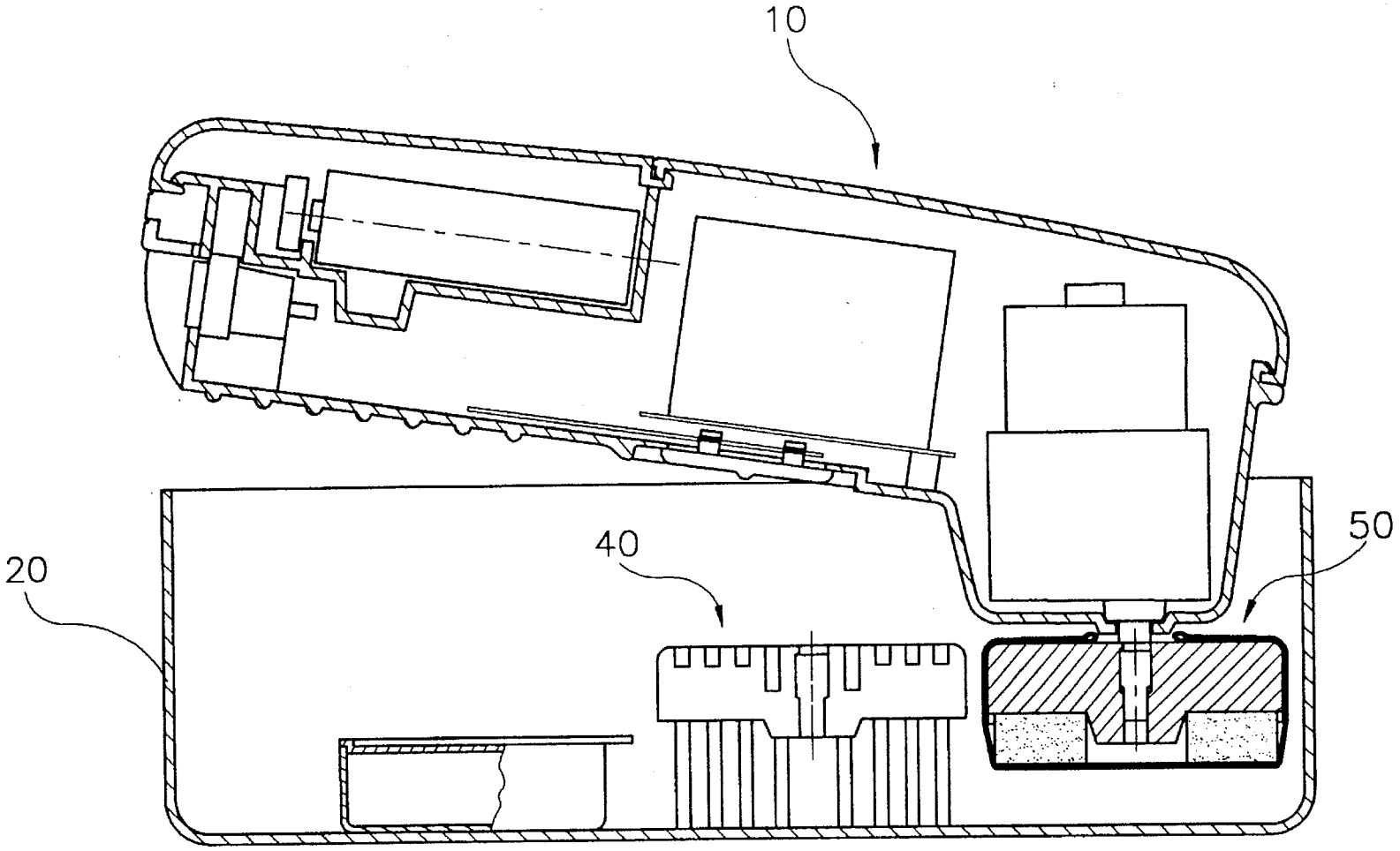
FIG. 8 is a diagramatic view showing transmission shaft inserted in the fixing hole of polishing member of the present invention.

Referring to FIG. 1, for practical use of the present invention, first withdraw said main body 10 from lower casing 20, then insert the transmission shaft 12 into the location hole 42 of said brush member 40, enabling said groove 121 to fasten with locating projection 421, said main body 10 can be removed together with brush member 40 (FIG. 6), then turn on power supply, the transmission shaft 12 on the motor 11 may drive said brush member 40 in rotation, said brush member 40 may remove dust or dirt on the shoe, upon completion of cleaning the shoe, turn off power supply, and store brush member 40 on transmission shaft 12 in the accommodating portion 25 of said lower casing 20, press down the flexible portion 23 beside said accommodating portion 25 to force the stopper portion 231 on said flexible portion 23 fasten the top edge of said fixing seat 41 (FIG. 7), withdraw said transmission shaft 12, then insert transmission shaft 12 into the fixing hole 52 of said polishing member 50 (FIG. 8), and coat the polish, then turn on power supply for shoeshining, upon completion of shoeshining, store said polishing member 50 in said accommodating portion 26, then store said main body 10 in lower casing 20 to attain the purpose of quick and convenient shoeshining.

According to the aforesaid description, the present invention has the following advantages:

1. Easy for carrying: because said shoeshine assembly comprises main body 10, polish 30, brush member 40, polishing member 50, and a lower casing 20 for receiving said members so that it is easy for carrying to achieve multifunctional shoeshine tool.
2. Effective use of room: because a proper room is left between said lower casing 20 and said main body 10, for receiving polish cup 30, brush member 40 and polishing member 50 so that the present invention will not cause waste of any space.
3. Convenient mounting of brush, polishing member, because said brush, fixing seats 41, 51 of polishing members 40, 50, respectively having locating projections 421, 521 may fasten with groove 121 on transmission shaft 12 without need of any hand tool.
4. No pollution to the user's hand: because on the edge wall of said lower casing 20 has a proper number of flexible portions 23, and said flexible portions 23 have stopper portion 231, for the replacement of said brush or polishing member 40, 50, press down said flexible portion 23, and said brush and polishing member 40, 50 fastening with transmission shaft 12 may be easily withdrawn with the help of stopper portion 231 retaining on the top edge of said fixing seats 41, 51, for receiving said two members in said accommodating portions 24, 25 so that the present shoeshine assembly is easy for use and not to pollute user's hand.

I claim:

1. A shoeshine kit comprising:

a main body having a rotatable transmission shaft, a motor for driving said transmission shaft, an upper casing to receive said main body and said motor, a brush member including a fixing seat with a fixing hole in a central portion thereof to receive said transmission shaft, a polishing member including a sponge, said polishing member including a fixing seat with a fixing hole in a central portion thereof to receive said transmission shaft, a polish cup to receive polish, a lower casing with an opening on a top side thereof and side walls, said lower casing including a plurality of fixing members defining accommodating portions therebetween to receive said brush member, said polishing member, and said polish cup; and wherein said lower casing has flexible portions which are affixed in grooves in said side walls of said lower casing, and said flexible portions are defined as flexible side walls with a stopper member thereon for retaining said brush member and said polishing member.

* * * * *